US005791280A

United States Patent [19]

Egan et al.

[11] Patent Number: 5,791,280

[45] Date of Patent: Aug. 11, 1998

[54] TOWABLE CARGO WATERCRAFT THAT IS TRANSPORTABLE ON A CAR-TOP CARRIER

[76] Inventors: Kerry P. Egan, New Star/FTS Box 1085, Dutch Harbor, Ak. 99692; Douglas J. Egan, 7470 Highway 53, Britt, Minn. 55710

[21] Appl. No.: 771,522

[22] Filed: Dec. 23, 1996

[51] Int. Cl.[6] ..... B63B 17/00

[52] U.S. Cl. ..... 114/361; 114/242; 224/486

[58] Field of Search ..... 114/361, 352, 114/353, 132, 152, 165, 242, 249, 250, 251, 62; 224/486, 315

[56] References Cited

U.S. PATENT DOCUMENTS

| | | | |
|---|---|---|---|
| Re. 26,363 | 3/1968 | Mills, II | 9/1 |
| 151,400 | 5/1874 | Keeler et al. . | |
| 1,690,285 | 11/1928 | Fleming . | |
| 2,068,921 | 1/1937 | Leigh | 114/140 |
| 2,659,464 | 11/1953 | SweeTman | 114/353 |
| 3,077,172 | 2/1963 | Dornak | 114/62 |
| 3,220,026 | 11/1965 | Lichti | 9/1 |
| 3,481,518 | 12/1969 | Anetsberger | 224/42.1 |
| 3,572,353 | 3/1971 | Pinkley | 135/6 |
| 3,684,139 | 8/1972 | Johnson | 114/353 |
| 5,119,752 | 6/1992 | Doherty | 114/361 |
| 5,235,926 | 8/1993 | Jones | 114/152 |
| 5,357,891 | 10/1994 | Kobayashi et al. | 114/242 |

FOREIGN PATENT DOCUMENTS

| | | | |
|---|---|---|---|
| 33 01 769 A1 | 7/1984 | Germany | 114/353 |
| 63-43888 | 2/1988 | Japan | 114/250 |

*Primary Examiner*—Sherman Basinger
*Attorney, Agent, or Firm*—James V. Harmon

[57] ABSTRACT

A towable cargo watercraft or boat is described that can be transported on a motor vehicle to and from the location where it is to be used. The craft includes a hollow hull comprising a rigid shell formed from plastic resin with a bottom wall, side walls and a transom extending upwardly and terminating in a wide upwardly facing open hatch. The hatch extends substantially from the bow to the stem of the watercraft and from one side of the craft to the other to allow easy access to a storage compartment inside the hull. A removable hatch cover is connected by a waterproof seal to a rim that encircles the hatch for covering and sealing the hatch when the watercraft is in use. A releasable latch is provided to hold the hatch closed during use, and the seal around the hatch maintains the watercraft in a weatherproof and watertight condition. The hull includes guide ribs and optionally, retractable stabilizing fins which extends longitudinally of the hull for directing the course of movement of the watercraft along a straight line through the water as the watercraft is being towed.

9 Claims, 3 Drawing Sheets

TOWABLE CARGO WATERCRAFT THAT IS TRANSPORTABLE ON A CAR-TOP CARRIER

FIELD OF THE INVENTION

This invention relates to towable cargo vessels and more particularly to a cargo carrying watercraft that is portable and capable of being transported on a car-top carrier.

BACKGROUND OF THE INVENTION

People who use watercraft often encounter storage and safety problems caused by having too much gear to carry in the boat. For example, when fishermen, duck hunters, campers and other pleasure boaters try to place in a boat more people, gear and equipment than is recommended by regulations, the weather or common sense, unsafe boating conditions often result. Consequently, it is a major objective of the present invention to find a way of safely transporting cargo, e.g., camping equipment, clothing, bedding, fishing and hunting equipment, and other gear in a convenient way that will not jeopardize the safety of the powered vessel, e.g., runabout, cruiser or motorboat in which people are transported.

It is another object of the invention to provide an auxiliary cargo boat that will function in two capacities: first, as a relatively small, lightweight, enclosed watertight cargo-carrying vessel for towing gear behind a powered watercraft such as a fishing boat, canoe, kayak, jet ski, etc. and second, as a unit that is transportable on a car-top carrier or on top of an automobile, motorhome or other vehicle.

A further object of the invention is to provide a cargo vessel that is rugged in construction, reliable in operation, and can be readily mass produced for safely carrying cargo items, e.g., luggage, camping and fishing gear, and can be used for transporting the cargo both on the water and while being carried on top of a motor vehicle.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a towable cargo watercraft or boat that can be transported on a motor vehicle or trailer to and from the location where it is to be used. The craft includes a hollow hull comprising a rigid shell formed from plastic resin with a bottom wall, side walls and a transom extending upwardly from the bottom wall and terminating in a wide upwardly facing open hatch. The hatch extends substantially from the bow to the stern of the watercraft and from one side of the craft to the other to allow easy access to a storage compartment inside the hull. A removable hatch cover is connected by a waterproof seal to a rim that encircles the hatch for covering and sealing the hatch when the cargo watercraft is in use. A releasable latch is provided to hold the hatch closed during use, and the seal around the hatch maintains the watercraft in a weatherproof and watertight condition. The hull includes guide means and optionally, retractable stabilizing fins which extend longitudinally of the hull for directing the course of movement of the watercraft along a straight line through the water as the watercraft is being towed.

THE FIGURES

DETAILED DESCRIPTION OF THE INVENTION

Figure 1:
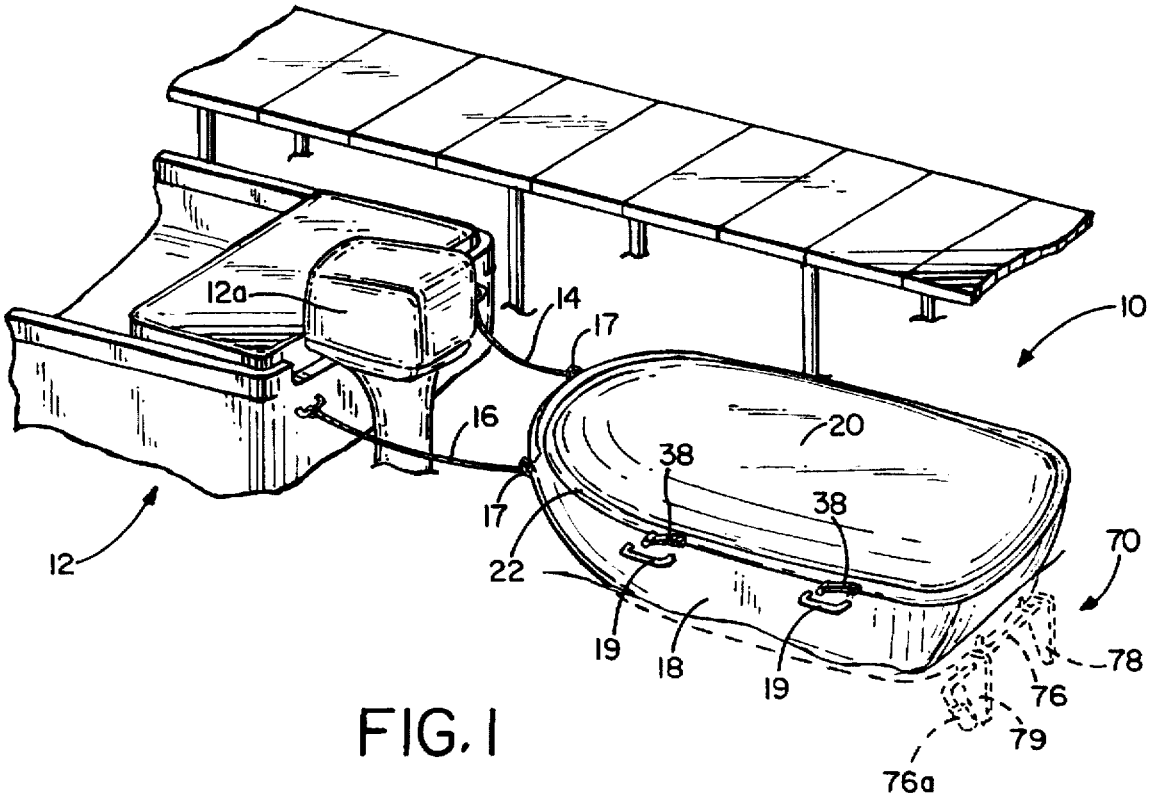
FIG. 1 is a perspective view of the invention as it appears in position to be towed behind a motorboat.
Figure 2:
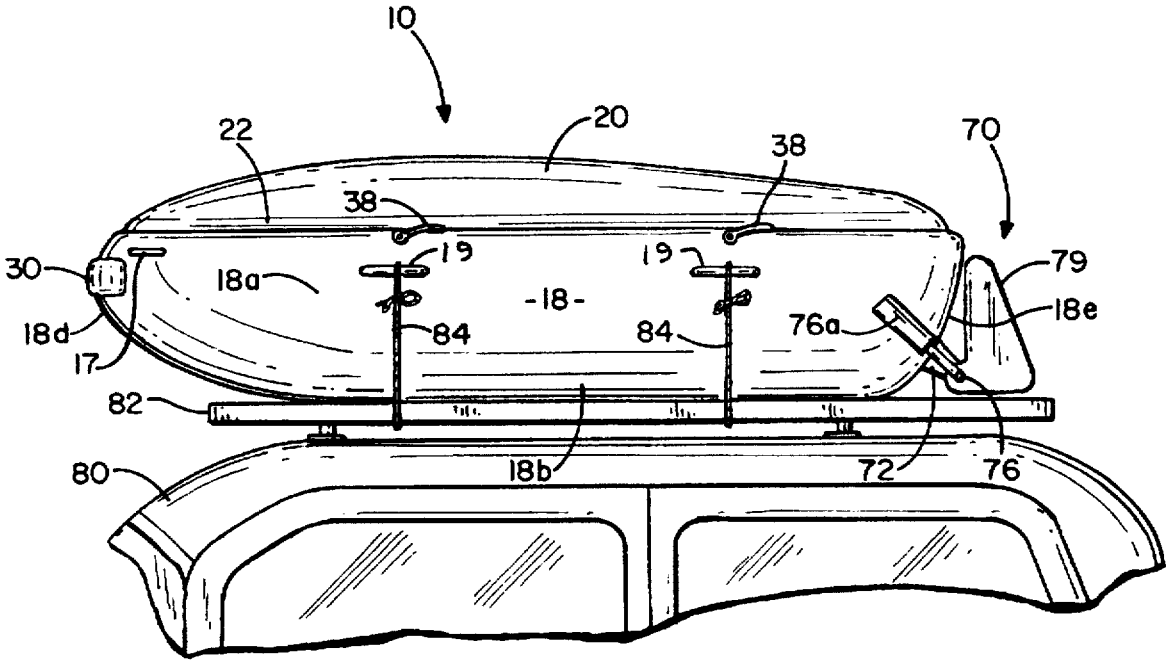
FIG. 2 is a side view of the invention mounted upon a car-top carrier.
Figure 3:
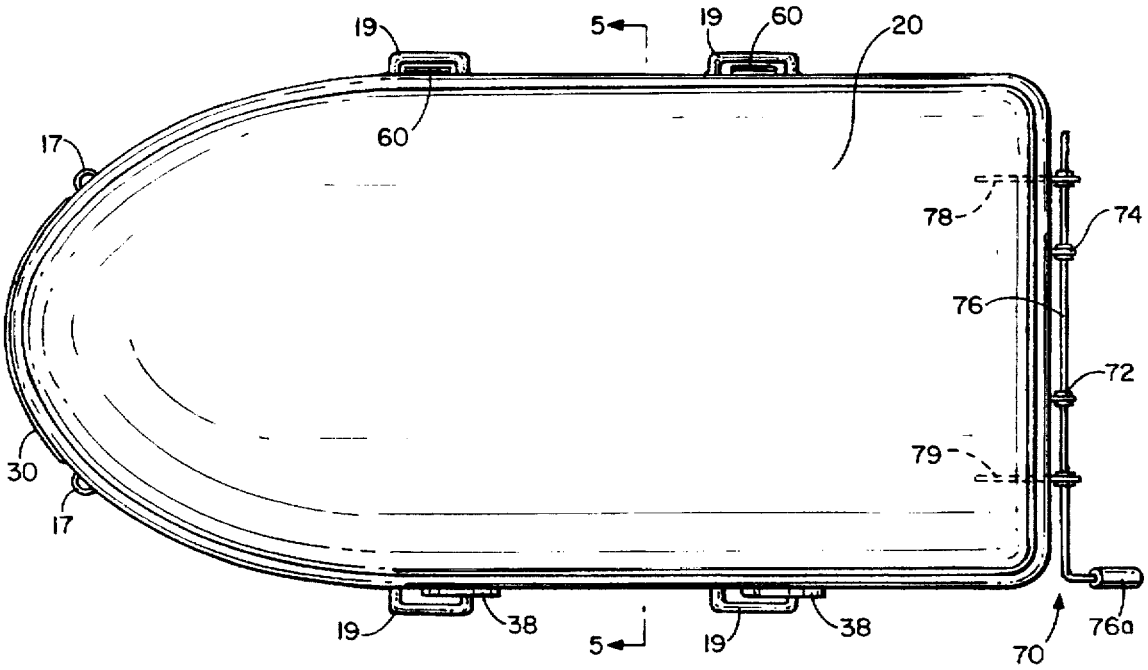
FIG. 3 is a top view of the invention.
Figure 4:
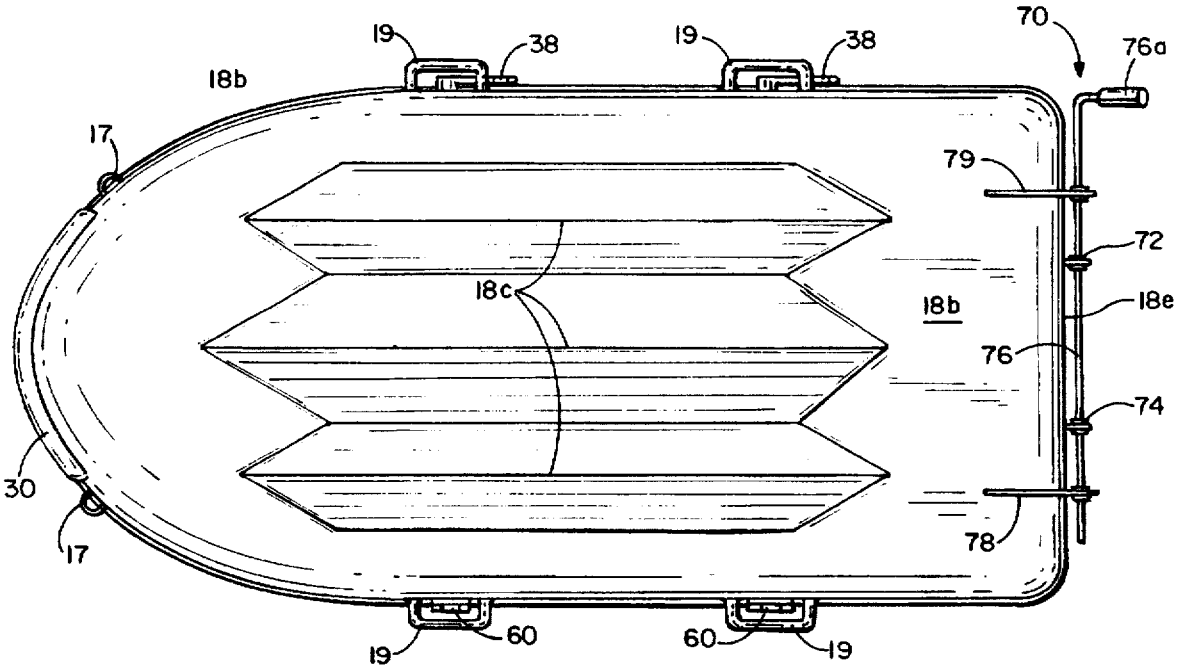
FIG. 4 is a bottom view of the invention.

Refer now to the figures and particularly to FIGS. 1–4. A cargo watercraft or boat indicated generally at 10 is unpowered and during use is towed behind a powered vessel such as a runabout, motorboat or other vessel, e.g., canoe, fishing boat, kayak, jet ski, etc. illustrated herein for example as a motorboat 12 powered by an outboard motor 12*a*. The cargo boat 10 in this case is towed by means of a pair of tow lines 14, 16 which are connected to integral fasteners 17 that are molded into the front of the hull 18 of the boat 10. The hull 18 comprises a rigid shell formed from plastic resin, preferably fiber reinforced, e.g., fiberglass or Kevlar reinforced polyester resin or non-reinforced polyethylene or polypropylene or other suitable plastic resin well known in the watercraft art. The hull 18 includes side walls 18*a*, a bottom wall 18*b* and a transom 18*e*. The bottom wall 18*b* has three downwardly projecting, upwardly opening and longitudinally extending, generally V-shaped guiding ribs or keels 18*c* that are molded integrally into the bottom wall 18*b* of the hull 18. As shown in FIG. 2, the vessel 10 is supported on a motor vehicle, in this case an automobile 80 having a car-top carrier 82 upon which the cargo carrying vessel 10 is directly placed. The vessel 10 is lashed down by means of cords or other fasteners 84 that are connected to U-shaped handle/cleats 19.

Figure 5:
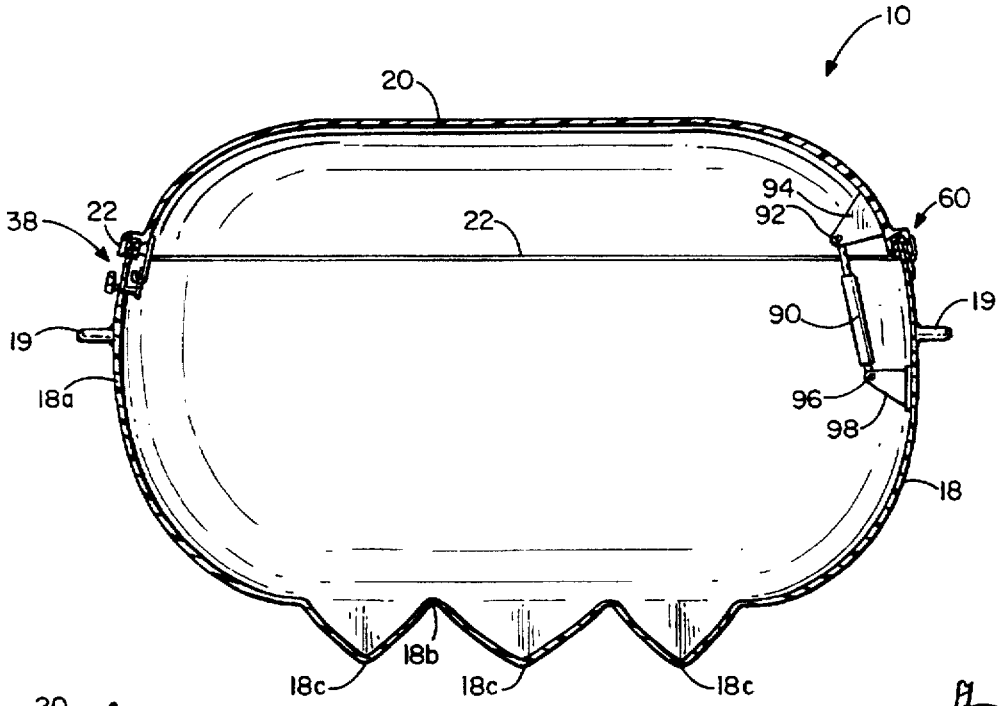
FIG. 5 is a vertical cross-sectional view taken on line 5—5 of FIG. 3.

As best shown in FIG. 5, the hull 18 is hollow and comprises a rigid thin-wall shell. The thickness of the hull 18 will vary depending on the size of the boat 10 and resin used, but is typically about 2 mm to 8 mm in thickness. Typically, the hull 18 will be from about four feet to eight feet long and optimally about six feet long. To the bow of the hull 18 is bonded a rubber bumper 30 (FIG. 2) that wraps around the foremost part of the hull 18 substantially in a horizontal plan intermediate the top and bottom of the vessel 10. It will be noticed in FIG. 5 that the side walls 18*a* of the hull 18 are outwardly curved, inwardly concave in shape. This facilitates the loading of cargo into the hull 18 and also helps to provide the greatest possible carrying capacity.

It will also be seen that the hatch cover 20 comprises a curved upwardly domed plastic sheet with a convexly curved outer surface and an inwardly facing concave surface to maximize the volume of the hull 18 for holding the greatest possible amount of cargo. It will also be seen that the hull 18 comprises a large unitary storage compartment that is open at the top substantially all the way from the bow of the vessel 10 to the transom 18*e*. This enables items to be easily loaded or removed from the hull.

It can be seen further that the hatch cover 20 is hinged to the hull 18 on one side and secured by means of latches 38 on the other side. This enables the hatch cover 20 to be opened and closed easily so that a tight, waterproof seal can be provided around the entire periphery of the hatch cover 20.

The hull 18 is provided with a pair of U-shaped plastic or metal handles or cleats 19 on each side to enable the hull to be lifted easily and also to serve as openings for tie-down cords. The hull 18 includes an upwardly facing open wide mouth 21 which functions as a hatch opening terminating upwardly in a rim 23. The hatch cover 20 is supported on the rim 23 of the hull 18 along a seal line 22. The hatch cover 20 can be formed from opaque or transparent plastic resin if it is desirable to see the cargo while it is being transported. The hatch cover 20 can be of any suitable resin, e.g., any of those mentioned above, or can be formed from transparent plastic such as polymethylmethacrylate, i.e., Plexiglas®, when transparency is desired.

Bonded to the rim 23 is a rubber gasket 36 having a U-shaped cross-sectional configuration. The hatch cover 20 has a similarly shaped downwardly opening peripherally extending channel 54 sized properly to fit onto and make a watertight seal with the rubber gasket 36 when the hatch cover 20 is closed as shown in FIGS. 1, 2 and 5.

Figure 7:
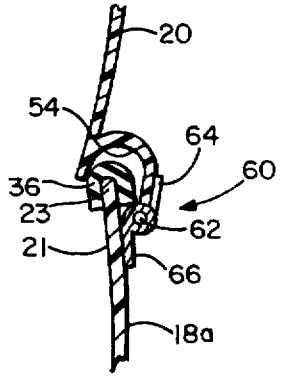
FIG. 7 is a vertical cross-sectional view of the hinge shown on the right side of FIG. 5 but on a larger scale in a partially open position.

The hatch cover 20 is removable so that it can be opened whenever the hull 18 is to be filled or emptied. Preferably, the hatch cover 20 is hinged, e.g., by means of a pair of hinges 60 shown here on the starboard side of the hull 18 in this case (FIGS. 5 and 7). The hinges 60 each comprise a hinge pin 62 connected between a pair of hinge plates 64, 66 that are attached to the cover 20 and the hull side wall **18*a* as shown in FIG. 7. The channel 54 is positioned to make a watertight seal against the rubber sealing gasket 36 when the hatch cover 20** is lowered.

Figure 6:
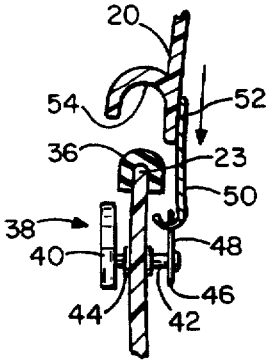
FIG. 6 is an enlarged cross-sectional view of the latch shown on the left side of FIG. 5 on a larger scale and in a partially open position.
Figure 8:
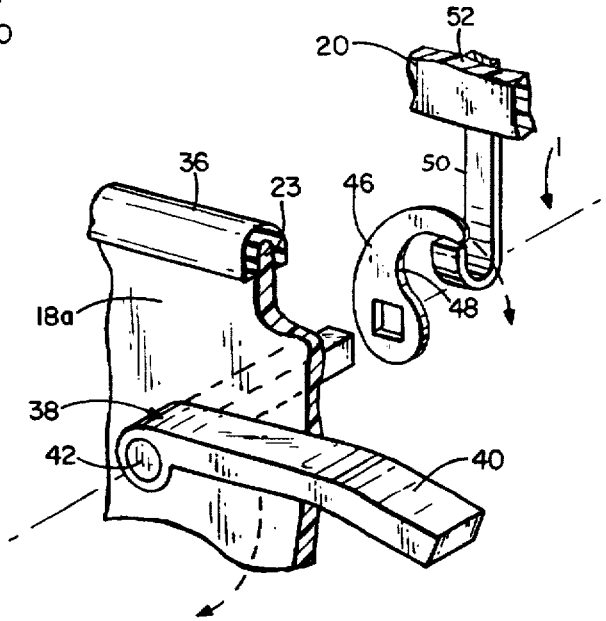
FIG. 8 is an exploded view of the latch shown in FIGS. 5 and 6 on a larger scale.

The hatch cover 20 is preferably secured in a locked position by means of a pair of latches 38 as shown in FIGS. 5, 6 and 8. The latches 38 each include a handle 40 connected rigidly to a shaft 42 that is journaled within a bearing 44 for rotation and having secured to its inner end, e.g., by welding, a latch 46 with an arcuately curved downwardly facing cam surface 48 that is adapted to engage and pull down a latching hook 50 that is secured rigidly to the hatch cover 20 when the handle 40 is depressed. Thus, as shown in FIG. 8, as the handle 40 is lowered, the shaft 42 will rotate in a clockwise direction, thereby turning the latch cam 46 in the same direction so as to pull the latch hook 50 and the hatch cover 20 downwardly causing the channel 54 makes a tight waterproof seal against the rubber gasket 36. In this way, the cargo within the watercraft 10 is kept dry while being towed as shown in FIG. 1 as well as when the watercraft 10 is mounted on a car-top carrier as shown in FIG. 2.

Refer now to FIGS. 1–4 which illustrate retractable guide fins used to help assure that the vessel 10 will move in a straight line when towed. As shown, a pair of bearing plates 72, 74 containing bearings are affixed rigidly directly to the rear wall, i.e., transom **18*e* of the hull 18, for holding a transverse supporting rod 76 for pivotal movement. Connected rigidly to the supporting rod 76 are a pair of laterally spaced apart, longitudinally oriented guide fins or plates 78, 79. At one end of the supporting rod 76 is a handle 76*a*. The handle 76*a* can be used as shown in FIG. 2 to rotate the supporting rod 76 in a counterclockwise as shown in the figure to raise the guide fins 78, 79 to a retracted position. This will enable the vessel 10 to be transported on a car-top carrier or other type of motor vehicle without the fins striking the top of the car. When the vessel 10 is to be towed during use as shown in FIG. 1, the handle 76*a* is moved in a clockwise direction so as to lower the guide plates 78, 79 to the operating position of FIG. 1. This will help to stabilize the vessel 10 while it is being towed and will cooperate with the guiding ribs 18*c* to help direct the vessel 10 along a straight line through the water as it is being towed behind a powered watercraft, e.g., motorboat 12**.

To hold the hatch cover 20 in the open position as shown in FIG. 5, an extendible position-retaining cylinder 90 of suitable known construction is preferably provided. In this case, the position-retaining cylinder 90 is supported upon bearings 92 and 96 at the end of support plates 94 and 98 that are connected rigidly to the hatch cover 20 and hull 18, respectively. Thus, during use the cylinder 90 will hold the hatch cover 20 in the open position while cargo is being placed in the hull 18.

The invention is rugged in construction, will reliably keep cargo in a safe, dry condition both while it is being towed behind a powered vessel 12 and also while it is supported on a motor vehicle, e.g., the car-top carrier of FIG. 2. Consequently, the watercraft 10 functions in two different capacities: first, as a relatively small, lightweight, enclosed watertight craft for being towed behind a watercraft such as a powered watercraft and second, as a storage unit to be transported on top of the owner's motor vehicle. It should also be noticed that the vessel 10 will be reliably guided along a straight line through the water by means of the ribs **18*c* and also by means of the guide fins 78, 79. Because the guide fins 78, 79 can be elevated to an out-of-the-way position, they do not interfere with the proper mounting of the vessel 10 on top of a car or other motor vehicle 80. The invention completely eliminates storage and safety problems that often occur when boaters, e.g., fishermen, duck hunters, camper, pleasure boaters and others place in a boat more people, gear and equipment than is recommended by safety standards, weather conditions or common sense. More over, the hull 18, hatch 20, latches 38 and gasket 36 provide a tight, waterproof seal around the open mouth of the hatch. The lifting handles/cleats 19 enable the vessel 10** to be easily carried and tied down, e.g., to the top of the motor vehicle. If desired, the invention can be constructed from a variety of materials in addition to plastic, e.g., wood or metal.

Many variations of the present invention within the scope of the appended claims will be apparent to those skilled in the art once the principles described herein are understood.

What is claimed is:

1. A portable amphibious cargo watercraft that is transportable upon a car-top luggage carrier, said watercraft comprising, 1) a hollow hull comprising a rigid shell formed from plastic resin and including a bottom wall and a pair of side walls and transom extending upwardly from the bottom wall that terminate in a wide, upwardly facing hatch opening at the upper aspect of the hull and a rim extending around the hatch opening, 2) a removable hatch cover supported on the rim for covering the hatch opening and extending substantially from one end of the watercraft to the other, 3) the hatch cover has an upwardly arched outer surface devoid of recessed areas in said outer surface and the cover has an inwardly facing concave surface to maximize the volume of a unitary storage compartment between the hatch cover and the hull, 4) a laterally positioned hinge connected between the hatch cover and the hull and being located on one side of the hull for enabling the hatch cover to be opened and closed by being pivoted about a fore and aft axis extending through the hinge such that said one side of the hatch cover is hingedly connected to a side edge of the hull to provide easy access to the entire hull from substantially one end thereof to the other end to thereby facilitate loading and unloading luggage from the hull, 5) a resilient sealing strip to provide a waterproof seal that extends around the entire periphery of the hull between the hatch cover and the rim of the hull whereby the sealing strip completely encircles the hull, 6) said hinge is positioned outboard of an adjacent portion of the waterproof seal on said one side of the hull such that the axis of the hinge extends longitudinally with the resilient sealing strip spaced centrally therefrom to permit said seal to be established entirely around the hull when the hatch cover is pivoted downwardly to a closed position about the hinge, and 7) a latch for connecting the hatch cover to the hull.

2. The cargo watercraft of claim 1 wherein the hull includes retractable stabilizing fin means.

3. The cargo watercraft of claim 2 wherein the fin means comprises at least one fin supported for articulation upon a horizontal axis to enable the fin to be elevated when the watercraft is to be transported or stored out of the water and to be lowered so as to extend into the water when the watercraft is afloat.

4. The cargo watercraft of claim 1 wherein the hull includes at least one longitudinally extending, downwardly projecting guiding rib on the bottom wall of the hull in a position normally submerged in the water when the watercraft is afloat for helping to direct the course of movement of the watercraft along a straight line.

5. The cargo watercraft of claim 4 wherein the hull includes a plurality of said ribs arranged in laterally spaced apart, longitudinally extending parallel positions.

6. The watercraft of claim 4 wherein the rib is a portion of said bottom wall that is formed with a deflection therein having a pair of adjacent aligned rib walls that are connected together at lower edges thereof so as to project downwardly from the hull.

7. The watercraft of claim 1 wherein the hatch comprises substantially the entire upper aspect of the watercraft and the hatch cover is hingedly connected to the hull for sealing the hatch when in a closed position.

8. The amphibious cargo craft of claim 1 wherein the watercraft hull comprises two sheets of plastic sheet material including a first sheet molded to define the side walls, transom and bottom walls of the watercraft hull and a second cover sheet comprising the top wall of the watercraft hull and being removably connected to the first sheet to provide access to the storage compartment within the watercraft hull.

9. The watercraft of claim 1 wherein the resilient sealing strip is bonded to the rim and the hatch cover has a downwardly opening, peripherally extending surface that fits the strip to form said waterproof seal when the hatch is closed.

* * * * *